US008251365B2

(12) United States Patent
Reuter

(10) Patent No.: US 8,251,365 B2
(45) Date of Patent: Aug. 28, 2012

(54) DEVICE AND METHOD FOR MONITORING THE SEPARATION OF A SHEET PRODUCT

(75) Inventor: Franz Reuter, Dorfen (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 12/669,228

(22) PCT Filed: Jul. 18, 2008

(86) PCT No.: PCT/EP2008/005920

§ 371 (c)(1),
(2), (4) Date: Jun. 11, 2010

(87) PCT Pub. No.: WO2009/010304

PCT Pub. Date: Jan. 22, 2009

(65) Prior Publication Data

US 2010/0276864 A1 Nov. 4, 2010

(30) Foreign Application Priority Data

Jul. 19, 2007 (DE) ..... 10 2007 033 747

(51) Int. Cl.
*B65H 7/02* (2006.01)

(52) U.S. Cl. ..... 271/258.01; 271/4.02; 271/10.02; 271/265.01

(58) Field of Classification Search ..... 271/4.02, 271/4.03, 10.02, 10.03, 256, 258.01, 265.01, 271/266, 110

See application file for complete search history.

(56) References Cited

U.S. PATENT DOCUMENTS

| | | | | |
|---|---|---|---|---|
| 5,833,229 | A * | 11/1998 | Prim | 271/11 |
| 6,109,522 | A * | 8/2000 | Force et al. | 235/379 |
| 7,128,314 | B2 * | 10/2006 | Iida | 271/4.02 |
| 7,584,951 | B2 * | 9/2009 | Otani et al. | 271/10.01 |
| 7,748,693 | B2 * | 7/2010 | Matsumoto | 271/10.03 |
| 7,871,073 | B2 * | 1/2011 | Noguchi et al. | 271/265.01 |
| 7,905,484 | B2 * | 3/2011 | Komuro | 271/263 |
| 2005/0082739 | A1 * | 4/2005 | Mitsuya et al. | 271/10.11 |
| 2007/0120315 | A1 | 5/2007 | Steinhilber | |
| 2008/0157465 | A1 * | 7/2008 | Matsumoto | 271/277 |

(Continued)

FOREIGN PATENT DOCUMENTS

DE 10224486 A1 12/2003

(Continued)

OTHER PUBLICATIONS

International Search Report in PCT/EP2008/005920, Nov. 18, 2008.

*Primary Examiner* — Kaitlin Joerger
*Assistant Examiner* — Prasad Gokhale
(74) *Attorney, Agent, or Firm* — Bacon & Thomas, PLLC

(57) ABSTRACT

The invention relates to a device and a method for monitoring the separation of a sheet product, particularly of banknotes. The invention is based on a device and a method for monitoring the separation of a sheet product, particularly of banknotes, by means of a separator (1, 2, 3) having a drive (4, 7) and a controller (8) for monitoring and controlling the angular speed (w) of the separator, and is based on monitoring of the angular speed of the separator by the controller for changes and the determination of faulty separation, if the change of the angular speed is greater than a permitted deviation, or if the angular speed falls below a threshold value (S).

8 Claims, 1 Drawing Sheet

U.S. PATENT DOCUMENTS

| | | | | |
|---|---|---|---|---|
| 2008/0232880 | A1* | 9/2008 | Noguchi et al. | 399/397 |
| 2009/0008861 | A1* | 1/2009 | Kasahara et al. | 271/10.03 |
| 2009/0160119 | A1* | 6/2009 | Komuro | 271/10.11 |
| 2009/0212488 | A1* | 8/2009 | Hashimoto et al. | 271/226 |
| 2009/0212491 | A1* | 8/2009 | Noguchi et al. | 271/265.04 |

FOREIGN PATENT DOCUMENTS

| | | | |
|---|---|---|---|
| DE | 102005056634 | A1 | 6/2007 |
| EP | 1477442 | A1 | 11/2004 |
| EP | 1512649 | A2 | 3/2005 |

* cited by examiner

DEVICE AND METHOD FOR MONITORING THE SEPARATION OF A SHEET PRODUCT

FIELD OF THE INVENTION

This invention relates to an apparatus and method for monitoring the singling of sheet material, in particular bank notes.

BACKGROUND

For the processing of sheet material, in particular bank notes, it is provided that the bank notes are input to an input area as loose stacks and singled by a singler. The individual bank notes are transferred by the singler to a transport system and supplied to processing. Conventional forms of processing for bank notes are acceptance, checking and recognition of the bank notes by means of sensors, whereby authenticity, type (currency, denomination), state (soiling, damage), etc., are ascertained. Based on the results of checking and recognition, the bank notes are thereafter e.g. sorted, stacked, bundled, destroyed, etc.

For the processing of bank notes in bank-note processing machines it is of fundamental importance that the bank notes are actually each present individually after singling by the singler. Hence, in the past a multiplicity of improvements have been proposed for improving the quality of singling and ensuring that only one bank note at a time is singled by the singler and in particular preventing the simultaneous singling of two or more bank notes.

For this purpose, elaborate mechanical improvements of the singler itself have for example been proposed. Likewise, it has been proposed to provide sensors immediately after the singler for ascertaining whether the singler has grasped more than one bank note upon singling.

Further problems occur upon singling when not only bank notes but also foreign bodies are input to the input area. These may be for example paper clips and staples that are fastened to one or more bank notes. However, the input bank notes frequently also include coins, credit cards or other objects that are usually kept together with bank notes. Such foreign bodies cause extreme disturbances in the singling of the bank notes. Normally it is necessary to employ a service person to remedy the resulting disturbances, because the foreign bodies block or damage the singler or even cause destruction of the singler or other parts of the bank-note processing machine, e.g. the transport system or the sensors of the bank-note processing machine.

Proposals have also been made in the past for remedying such problems. For example, sensors have been disposed in the input area for ascertaining the presence of metallic foreign bodies. This makes it possible to ascertain the presence of coins, paper clips, etc., and to terminate or even prevent the onset of the singling process, but non-metallic foreign bodies, e.g. credit cards, are not recognized and lead to the above-described problems.

SUMMARY

Starting out from this prior art, the invention is based on the problem of specifying an apparatus and method for monitoring the singling of sheet material, in particular bank notes, by means of a singler that, without elaborate mechanical improvements of the singler itself and without the use of additional sensors, clearly improve the quality of singling and prevent disturbances upon the presence of foreign bodies.

The invention starts out from an apparatus and method for monitoring the singling of sheet material, in particular bank notes, by means of a singler having a drive and a control device for a monitoring and control of the angular velocity of the singler, and is based on a monitoring of the angular velocity of the singler by the control device for changes and an ascertainment of a faulty singling if the change in angular velocity is greater than a permissible deviation or the angular velocity undershoots a threshold value.

The advantage of the inventive solution consists in the fact that it can be reliably recognized without additional effort whether faults occur upon the singling of sheet material with the inventive singler, in particular whether double or multiple removals of sheet material are effected or whether foreign bodies are grasped by the singler.

In a development it is provided that a time duration between two singling processes is monitored and a faulty singling is ascertained if the monitored time duration undershoots a predetermined time duration.

The development has the advantage that double or multiple removals can also be recognized that arise from the overlap of bank notes or from foreign bodies.

BRIEF DESCRIPTION OF THE DRAWINGS

Further embodiments and advantages of the invention will be explained hereinafter with reference to the figures and the description thereof.

Therein are shown

DETAILED DESCRIPTION OF VARIOUS EMBODIMENTS OF THE DISCLOSURE

Figure 1:
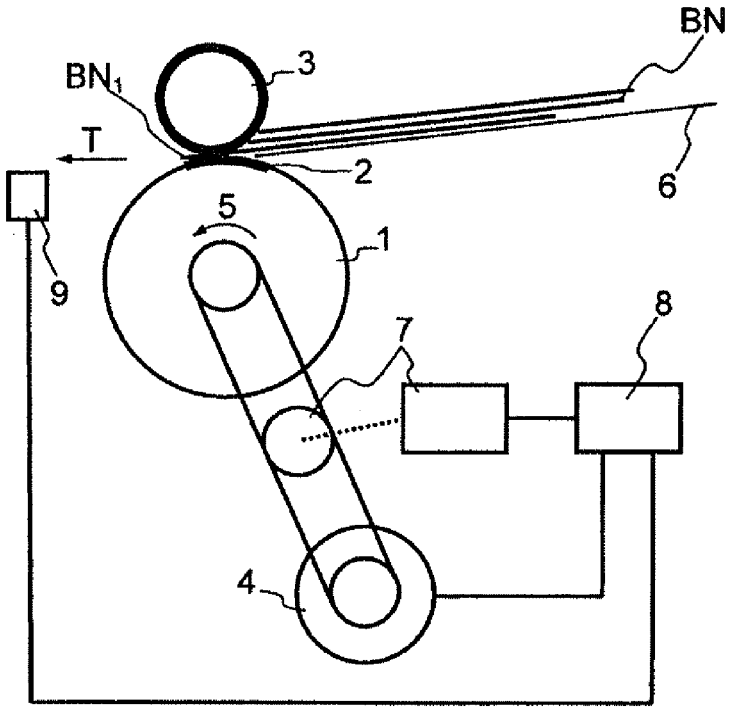
FIG. 1 a schematic structure of a singler, for singling sheet material, in particular bank notes, and FIG. 2 a schematic time course of an angular velocity of the singler according to FIG. 1.

FIG. 1 shows a schematic structure of a singler, for singling sheet material, in particular bank notes.

The singler is constructed as a so-called friction wheel singler which has a singling element 1 with a friction element 2 and a retaining element 3. The singling element 1 is of wheel- or roller-shaped construction and has the friction element 2 within a certain part of its circumference. The friction element 2 has a higher coefficient of friction in comparison to the remaining surface of the singling element 1. It is thus achieved that bank notes BN, $BN_1$ to be singled, which are input to an input area 6 for singling, are only grasped and singled by the friction element 2 when the singling element 1 is turned in a predetermined first direction 5 by a drive 4, 7. Thus, only one bank note $BN_1$ is grasped and singled by the friction element 2 upon a complete rotation of the singling element 1.

In order for further bank notes BN located in the input area 6 together with the bank note $BN_1$ just grasped by the singling element 1 or its friction element 2 to be retained from grasping and singling, the retaining element 3 is provided. The retaining element 3 has an elevated coefficient of friction over its total circumference. By the choice of the coefficients of friction and/or by geometrical specifications of retaining element 3 and singling element 1, with the associated friction element 2, it is achieved that upon the rotation of the singling element 1 there result ratios of forces that enable the singling of a bank note $BN_1$ and the retention of further bank notes BN. Likewise, it is possible that the retaining element 3 is also driven. However, a rotation direction is chosen therefor that counteracts the rotation direction 5 of the singling element 1 to cause the retention of the further bank notes BN.

The structure of such a singling element 1 with the associated friction element 2 and retaining element 3 is described for example in DE 102 24 486 A1. The retaining element 3 can also have another, for example runner-like, form.

After the singling of the bank note $BN_1$ it is transferred to a transport system (not shown) which is part of a bank-note processing machine (likewise not shown), and the singled bank notes are transported in a transport direction T for further processing through the bank-note processing machine, where they are for example checked by sensors 9 and processed in the above-described manner.

The drive 4, 7 of the singling element 1 consists of a motor 4 which drives the singling element 1 for example by means of a toothed belt. By means of a speed indicator 7 the angular velocity or rotating speed of the singling element 1 is ascertained. The speed indicator 7 can be constructed at will, for example as an optical rotary encoder. A control device 8 evaluates the signals of the speed indicator 7 to adjust a predetermined target velocity of the singling element 1, for which purpose the control device 8 regulates the motor 4. The control device 8 regulates in the same manner the speed of the transport system of the bank-note processing machine to synchronize it with the singler. Further, the control device 8 can process the signals of the sensors 9 of the bank-note processing machine. The control device 8 can be formed for example by a microprocessor. As a working memory the microprocessor can have a volatile memory, as well as a non-volatile memory for permanent storage of software and parameters for the operation of the singler or the bank-note processing machine.

Figure 2:
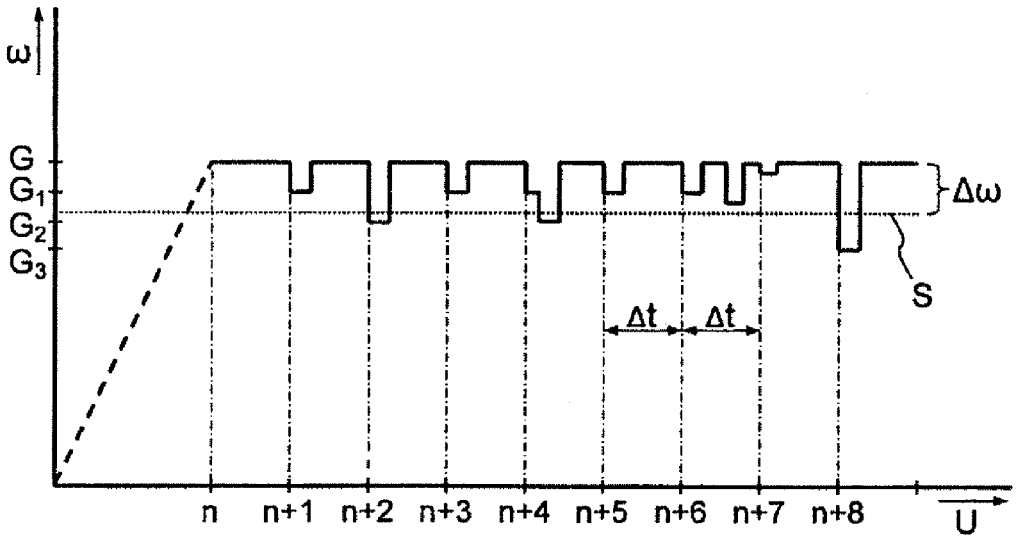

In FIG. 2 there is shown a schematic time course of an angular velocity of the singler according to FIG. 1.

The angular velocity ω of the singling element 1 is adjusted to a predetermined target velocity G, as described above, by the control device 8 by means of the signals of the speed indicator 7, by regulation of the motor 4. In the shown example, the target velocity G is reached after n rotations U of the singling element 1, and the singling of bank notes can be begun. For further operation the control variables for the regulation of the motor 4 as ascertained by the control device 8 are maintained. A readjustment upon longer operation is possible.

At the time of a rotation n+1 the friction element 2 of the singling element 1 has grasped the individual bank note $BN_1$ in order to single it. By the mechanical resistance that the bank note $BN_1$ causes in the gap between singling element 1 and retaining element 3, and because of the energy required for accelerating the bank note $BN_1$, a slight change is to be observed in the angular velocity ω of the singling element 1 to a first velocity $G_1$ which is lower than the target velocity G. After a short time the predetermined target velocity G is reached again.

At the time of a rotation n+2 the friction element 2 of the singling element 1 has faultily grasped two bank notes in order to single them. By the mechanical resistance that the two bank notes cause in the gap between singling element 1 and retaining element 3, and because of the energy required for accelerating the bank notes, a stronger change is to be observed in the angular velocity ω of the singling element 1 than in the case described above for one bank note $BN_1$, to a second velocity $G_2$ which is lower than the target velocity G and the first velocity $G_1$. The second velocity $G_2$ characterizes a so-called double removal.

At the time of a rotation n+3 the singling of an individual bank note is again to be observed, which again leads to a change to the first velocity $G_1$.

At the time of a rotation n+4 the friction element 2 of the singling element 1 has first grasped a bank note in order to single it. Therefore, the above-described change in the angular velocity ω of the singling element 1 to the first velocity $G_1$ is to be observed. However, shortly thereafter, still by the friction element 2, a further bank note is faultily grasped and singled by the singling element 1, e.g. because the further bank note is adhering to the previously grasped bank note. In this case a further change occurs in the angular velocity ω of the singling element 1, resulting in total in the above-described second velocity $G_2$. The second velocity $G_2$ again characterizes a so-called double removal, which is also designated overlapping removal because of the mutual offset of the bank notes.

At the time of a rotation n+5 the singling of an individual bank note is again to be observed, which leads to a change to the first velocity $G_1$.

At the time of a rotation n+6 the friction element 2 of the singling element 1 has first grasped a bank note in order to single it. Therefore, the above-described change in the angular velocity ω of the singling element 1 to the first velocity $G_1$ is to be observed. Faultily, during the singling of said bank note a further bank note is grasped and singled by the singling element 1, e.g. because the further bank note is adhering to the previously grasped bank note. In this case there occurs a new change in the angular velocity ω of the singling element 1, which can be slightly greater than the above-described first velocity $G_1$. However, the new change in the angular velocity ω of the singling element 1 occurs at a time when no singling is normally expected, so that no change in angular velocity ω should be observed. Due to the above-described structure of the singling element 1 and its friction element 2 a new change in angular velocity ω may only be observed after a complete rotation of the singling element 1, i.e. the velocity changes through singling can in fault-free operation occur only regularly after a predetermined time duration Δt which is given by the target velocity of the singling element 1. Therefore, the brief successive occurrence of changes in angular velocity ω after the time of the rotation n+6 within the predetermined time duration Δt characterizes a faulty singling process, which can likewise be interpreted as overlapping removal. Instead of an overlapping removal, the occurrence of changes in the angular velocity ω of the singling element 1 at a time when no singling is normally expected, i.e. within the predetermined time duration Δt, can also be an indication of a foreign body that has been drawn in together with the just singled bank note, e.g. staples or paper clips fastened to the bank note.

At the time of a rotation n+7 no singling is to be observed. For the second bank note of the overlapping removal described for the time of the rotation n+6 has not yet left the area between singling element 1 and retaining element 3 at the time of the rotation n+7, so that the second bank note still present causes an only small change in angular velocity ω, but prevents a new bank note from being singled because the faultily singled second bank note is covering the friction element 2.

At the time of a rotation n+8 the friction element 2 of the singling element 1 has faultily grasped more than two bank notes in order to single them. By the mechanical resistance that the bank notes cause in the gap between singling element 1 and retaining element 3, and because of the energy required for accelerating the bank notes, a stronger change is to be observed in the angular velocity ω of the singling element 1 than in the cases described above for one or two bank notes, to a third velocity $G_3$ which is lower than the target velocity G and the first and second velocities $G_1$ and $G_2$. The third velocity $G_3$ characterizes a so-called triple or multiple removal. However, a strong change in the angular velocity ω to e.g. the third velocity $G_3$ or lower can also occur if foreign bodies such as staples or paper clips, coins or credit cards, etc., are grasped by the singler.

For improving the monitoring of the singling by the singler, the above-described changes in angular velocity ω that occur upon faulty singling processes can advantageously be taken into account. For this purpose it can be provided that the control device 8 evaluates the signals made available by the speed indicator 7 in order to evaluate changes in angular velocity ω during the operation of the singler in order to monitor the singling and be able to recognize faulty singling processes.

By evaluation of fault-free singling processes in which only individual bank notes are singled as desired, it is possible to ascertain typical values of the first velocity $G_1$ to be able to recognize correct singling processes of individual bank notes by means of the change in angular velocity ω. In the same manner it is possible to ascertain typical values of the second and third velocities $G_2$ and $G_3$ to be able to recognize faulty singling processes, e.g. double or multiple removals, by means of the change in angular velocity ω. By definition of a threshold value S for angular velocity ω which is smaller than the first velocity $G_1$ and greater than the second and third velocities $G_2$ and $G_3$ there can be formed a criterion that is suitable for ascertaining faulty singling processes. The threshold value S can be stored in the non-volatile memory of the control device 8. Alternatively, it can be checked whether the change in angular velocity ω is greater than a permissible deviation Δω. The permissible deviation Δω lies between a value resulting from subtraction of the first velocity $G_1$ from the target velocity G, and a value resulting from subtraction of the second velocity $G_2$ from the target velocity G. In this case the permissible deviation Δω is stored in the non-volatile memory of the control device 8.

In operation, the control device 8 monitors the angular velocity ω of the singling element 1 by means of the signals of the speed indicator 7. If changes occur in angular velocity ω that are greater than the permissible deviation Δω, or if the angular velocity ω is below the threshold value S, there is recognized by the control device 8 a faulty singling process in which more than one bank note is singled or in which foreign bodies are grasped by the singler.

Furthermore, the control device 8 can recognize faulty singling processes, e.g. overlapping removals or the grasping of foreign bodies, when it monitors not only the change in angular velocity ω, but also whether further changes in angular velocity ω occur in addition to the changes in angular velocity ω expected at the respective times after a complete rotation n, n+1, n+2, . . . , i.e. the changes in angular velocity ω occur more frequently than defined by the predetermined time duration Δt.

If a faulty singling process was ascertained by the control device 8, e.g. because a change in angular velocity ω was recognized or because changes in angular velocity ω were ascertained at a time interval smaller than the predetermined time duration Δt, the control unit 9 can take measures to prevent disturbances in or damage to the singler or the bank-note processing machine.

For this purpose it can be provided that the control device 8 stops the motor 4. The faultily drawn in bank notes or foreign bodies can then be removed from the singler by an operator.

Likewise, it is possible that the control device 8 controls the motor 4 such that the latter turns the singling element 1 for a certain time duration in a second direction that is opposite the first direction 5 and then stops it. In this case the faultily drawn in bank notes or foreign bodies are moved back out of the singler into the input area 6 and can be removed by the operator there.

On a display device (not shown) of the bank-note processing machine there can in addition be displayed indications for the operator that are generated by the control device 8. If the presence of foreign bodies is inferred on account of the above-described monitoring by the control device 8, an indication can be displayed that prompts the operator to remove foreign bodies. If double or multiple removals are inferred, in contrast, an indication can be displayed that prompts the operator to remove the bank notes from the input area 6, break them up so that e.g. bank notes adhering to each other are separated, and reinsert the bank notes into the input area 6. Subsequently, the singling or processing of the bank notes can be recommenced.

It is evident that it is advantageous to recognize the presence of a faulty singling as early as possible, because in this case the above-described measures for eliminating the faulty state can be carried out especially effectively. This is guaranteed by the above-proposed recognition of faulty singlings as soon as the time of onset of the singling process by means of the change in the angular velocity ω of the singler then setting in.

During operation of the singler it can happen that the defined threshold value S and/or the defined permissible deviation Δω deliver dissatisfactory results in the recognition of faulty singling processes upon the monitoring of the singling process. This can be due for example to bank notes of a certain currency being employed for the definition of the threshold value S or the permissible deviation Δω while bank notes of another currency are to be singled or processed. However, the stated dissatisfactory results can also be caused by a multiplicity of other reasons which have their cause in the properties of the particular bank notes to be singled or processed. Another such reason can be the state of the bank notes. For example, if the bank notes have strong traces of usage they behave differently upon singling compared to practically new bank notes, because used bank notes no longer have the stiffness of new bank notes, so that one generally speaks of limp bank notes.

To avoid such problems it can be provided that the threshold value S and/or the permissible deviation Δω are adapted automatically by the control device 8 during operation of the singler to the properties of the bank notes to be processed.

For this purpose there can advantageously be used one of the sensors 9 already present in the bank-note processing machine, which is employed for determining the thickness or state of the processed bank notes. From the signals of said sensor 9 the control device 8 determines the thickness as well as the state of the particular bank note present at the sensor 9 and whether it involves one or several bank notes. Such sensors 9 work for example with ultrasonic signals. If more than one bank note is present at the sensor 9, the ultrasonic signal is very greatly attenuated, so that it can be reliably recognized that at least two bank notes are present.

In the control device 8 the signals of the sensor 9 are evaluated and the presence of an individual bank note or the presence of more than one bank note is inferred. Additionally there is stored in the memory of the control device 8, upon the singling of the particular bank note, the value of angular velocity ω that changed at the onset of singling. Said value of the change in angular velocity ω upon singling stored for the particular bank note is correlated by the control device 8 with the evaluation of the signals of the sensor 9. Thus a reliable statement is possible of whether the stored value of the change in angular velocity ω was caused by one bank note or several bank notes. In the control device 8 the thus ascertained values of the change in angular velocity ω upon singling are stored for faultlessly singled (individual) bank notes and faultily singled (several) bank notes. By mathematical evaluations, e.g. by averaging, there can be ascertained a value at least of the above-described first velocity $G_1$ that is adapted to the actual conditions of the singled or processed bank notes. Likewise, it is also possible for values of the second and third velocities $G_2$ and $G_3$ to be ascertained by the control device 8. The ascertainment of the values of the second and third velocities $G_2$ and $G_3$ can also be omitted, because the value of the first velocity $G_1$ is crucial for the definition of the threshold value S or the permissible deviation Δω. The threshold value S is so defined here that it is smaller than the value of the first velocity $G_1$. The permissible deviation Δω is so defined that it is greater than the difference of target velocity G and first velocity $G_1$. Thus it is possible to adapt the threshold value S or the permissible change Δω for angular velocity ω in the above-described manner to the actual conditions coming about through the bank notes to be singled and processed.

The invention claimed is:

1. A method for monitoring singling of sheet material using a singler having a drive and a control device for monitoring and controlling angular velocity (ω) of the singler comprising the steps:

monitoring changes in angular velocity (ω) of the singler, monitoring a time duration between two singling processes, identifying a faulty singling when the change in angular velocity (ω) is greater than a permissible deviation (Δω), the angular velocity (ω) undershoots a threshold value (s), or the time duration undershoots a predetermined time duration (Δt), adapting the threshold value (S) or the permissible deviation (Δω) to properties of sheet material (BN) to be singled, storing velocities ($G_1$, $G_2$) of the singler at times of the changes in angular velocity (ω), correlating the stored velocities ($G_1$, $G_2$) with information about the presence of a faulty or fault-free singling which is derived from a sensor from the sheet material after singling, and adapting the threshold value (S) or the permissible deviation (Δω) by the control device on the basis of the velocities (G1, G2) correlated with the information about the presence of the faulty or fault-free singling.

2. The method according to claim 1, further comprising the step stopping the drive of the singler when a faulty singling is identified.

3. The method according to claim 1, further comprising the step reversing a predetermined rotation direction of the drive of the singler when a faulty singling is identified.

4. The method according to claim 1, wherein the predetermined time duration (Δt) is evaluated by changes in angular velocity (ω).

5. An apparatus for monitoring the singling of sheet material comprising:

a singler, a drive and a control device arranged to monitor and control the angular velocity (ω) of the singler, and wherein the control device is configured to monitor changes in angular velocity (ω) of the singler and monitor a time duration between two singling processes to identify a faulty singling when the change in angular velocity (ω) is greater than a permissible deviation (Δω), the angular velocity (ω) undershoots a threshold value (S), or the monitored time duration undershoots a predetermined time duration (Δt), to adapt the threshold value (S) or the permissible deviation (Δω) to properties of sheet material (BN) to be singled, to store the velocities ($G_1$, $G_2$) of the singler at the times of the change in angular velocity (ω), to correlate the stored velocities ($G_1$, $G_2$) with information about the presence of a faulty or fault-free singling which is derived from a sensor from the sheet material (BN) after singling, and to adapt the threshold value (S) or the permissible deviation (Δω) by the control device on the basis of the velocities ($G_1$, $G_2$) correlated with the information about the presence of a faulty or fault-free singling.

6. The apparatus according to claim 5, wherein the control device is further configured to stop the singler when a faulty singling is identified.

7. The apparatus according to claim 5, wherein the control device is further configured to reverse a predetermined rotation direction of the drive of the singler when a faulty singling is identified.

8. The apparatus according to claim 5, wherein the predetermined time duration (Δt) is evaluated by changes in angular velocity (ω).

* * * * *